US007441571B2

(12) United States Patent
Stager et al.

(10) Patent No.: US 7,441,571 B2
(45) Date of Patent: Oct. 28, 2008

(54) CONICAL CHIPPER/CANTER HEAD

(75) Inventors: Bradley R. Stager, Beaverton, OR (US); Jianmin Liao, Tigard, OR (US)

(73) Assignee: Key Knife, Inc., Tualatin, OR (US)

( * ) Notice: Subject to any disclaimer, the term of this patent is extended or adjusted under 35 U.S.C. 154(b) by 0 days.

(21) Appl. No.: 11/245,505

(22) Filed: Oct. 7, 2005

(65) Prior Publication Data

US 2007/0079900 A1 Apr. 12, 2007

(51) Int. Cl.
*B27C 1/00* (2006.01)

(52) U.S. Cl. ..... 144/162.1; 144/39; 144/220; 144/241

(58) Field of Classification Search ..... 144/39, 144/162.1, 172–174, 218, 220, 230, 235, 144/241; 241/91–93, 291, 292.1, 293, 296
See application file for complete search history.

(56) References Cited

U.S. PATENT DOCUMENTS

| | | | | |
|---|---|---|---|---|
| 3,330,315 | A | 7/1967 | Tomlinson, II | |
| 3,570,567 | A | 3/1971 | Hickman | |
| 3,777,793 | A | 12/1973 | MIller | |
| 4,082,127 | A | 4/1978 | Miller | |
| 4,161,972 | A * | 7/1979 | Hanaya | 144/176 |
| 4,793,390 | A * | 12/1988 | Stroud | 144/39 |
| 5,439,039 | A | 8/1995 | Bradstreet et al. | |
| 5,511,597 | A | 4/1996 | Shantie et al. | |
| 5,709,255 | A | 1/1998 | Toogood | |
| 5,816,301 | A | 10/1998 | Stager | |
| 5,819,826 | A * | 10/1998 | Schmatjen | 144/241 |
| 5,983,967 | A * | 11/1999 | Gross et al. | 144/235 |
| 6,167,929 | B1 | 1/2001 | Stager et al. | |
| 6,227,267 | B1 * | 5/2001 | Michell et al. | 144/220 |
| 6,772,810 | B1 * | 8/2004 | Bouchard et al. | 144/220 |
| 6,923,227 | B2 * | 8/2005 | Robitaille | 144/176 |
| 2004/0250898 | A1 * | 12/2004 | Rautio | 144/218 |
| 2005/0166998 | A1 * | 8/2005 | Biller | 144/220 |

FOREIGN PATENT DOCUMENTS

WO PCT/US2006/039261 1/2007

* cited by examiner

*Primary Examiner*—Shelley Self
(74) *Attorney, Agent, or Firm*—Portland Intellectual Property, LLC

(57) ABSTRACT

A conical chipper/canter head. The head includes, at least, one or more chipping knives. Each chipping knife provides at least one pair of linear cutting edges including a face cutting edge and a chip cutting edge angled with respect to each other. The face cutting edge defines a planar, face cutting surface of revolution of the cutting head, and the chip cutting edge defines a conical, chip cutting surface of revolution of the cutting head. The face and chip cutting edges of the same chipping knife lie in substantially the same plane. A cutting head may include a plurality of facing knives and corresponding clamping members in addition to one or more chipping knives. The facing knives and corresponding clamping members are adapted so that each of the facing knives is removable from the cutting head without removing any other facing knives.

43 Claims, 11 Drawing Sheets

CONICAL CHIPPER/CANTER HEAD

FIELD OF THE INVENTION

The present invention relates to a conical chipper/canter head, such as is typically employed for cutting and chipping logs in a sawmill, for processing the logs into lumber for use in construction.

BACKGROUND

In sawmills, logs are cut into slab sided articles of wood in the process of converting the logs into useable lumber. For this purpose, the log is fed into a device referred to as a chipper or canter (hereinafter "chipper/canter"). The chipper/canter has a rotating cutting head incorporating a plurality of cutting members, typically removable knives, saws, or combinations thereof. The cutting head is variously referred to as a chipper head, canter head, slabbing head, or conical head. The term "chipper" refers to one function of the chipper/canter, i.e., to produce chips that are used to form other wood products, such as oriented strand board. The term "canter" refers to another function of the chipper/canter, i.e., to cut a piece from the log, referred to as a "cant," having at least two parallel, substantially flat or slab sides, and the term "slabbing" refers to producing one or more of these sides. All of these heads are termed "conical" heads due to their geometry; the cutting surface defined by rotation of the head is actually frustoconical in shape.

The cutting head rotates about its axis of symmetry and the log is translated toward the head in a direction that is aligned with the longitudinal axis of the log and perpendicular to the axis of rotation of the head, causing the log to interfere with the cutting surface of the head and thereby cutting the log to produce both elongate, slab sided articles of wood and chips.

There are typically two opposed cutting heads operating on the log at substantially the same time to produce, during one pass of the log, two sided cants, and often there are four cutting heads for producing four sided cants from the log in a single cutting operation.

As the cutting surface defined by the rotating conical cutting head is actually frustoconical, it includes a flat annular portion as well as a conical portion that flares outwardly from the annular portion. The plane of the annular portion of this cutting surface is in the plane of the slab sides of the articles of wood and produces a finish on these sides. However, the log first encounters the conical portion of the cutting surface of the rotating cutting head, which cuts and tears chips from the log in preparation for the finishing provided by the annular portion as translation of the log in the direction just indicated is continued.

It will be appreciated that a significant quantity of the log must be removed as chips because the cross-section of the log is roughly circular while it is desired to cut pieces from the log whose cross-sections are rectilinear (hereinafter "lumber"). However, even though the chips themselves have economic value, it is often desirable to minimize the degree to which the log must be reduced to chips in favor of producing lumber.

The aforedescribed annular portion of the cutting surface defined by the rotating conical cutting head is typically produced either by a plurality of circumferentially spaced knives, or a disk-saw. Any such structure is referred to hereinafter as a "facing" portion of the cutting head because it produces a "facing" cut on the log that defines the slab sides of the lumber.

The aforedescribed conical portion of the cutting surface is typically produced by a plurality of staggered knives that are often arranged in spaced apart circular patterns, or alternatively in a spiral pattern, so as to trace a frustoconical surface as the head rotates. Any such structure is referred to hereinafter as a "chipping" portion of the cutting head because it cuts chips from portions of the log that are not used to produce lumber. The knives of the chipping portion are attached to a body of the head either directly or through intermediate members, and the body of the head may or may not itself be frustoconical in shape, a configuration which is often referred to in the art as "solid."

The surface finished produced by the cutting head is affected by a number of factors, e.g., the extent to which the cutting head is in balance, the density of cutting elements, the speed of rotation, the speed of travel of the lumber, and the ability of the apparatus to efficiently keep chips away from the cutting surface as it is being cut. It has been observed in the course of practice that the best surface finishes are typically provided by cutting heads employing facing portions incorporating disk-saws rather than knives. Still, the surface finish provided by the cutting head, at least in the first instance of processing raw logs, is not as fine as would be desirable. The cut lumber is therefore oversized to allow additional removal of material in subsequent finishing steps, to refine the surface finish. The removal of this additional material, typically in the form of sawdust, represents a waste of material and consumes processing resources. Therefore, it is important to improve the surface finish provided by the cutting head, and there is a need for a conical chipper/canter head providing such an improvement.

SUMMARY

A conical chipper/canter head is disclosed herein. The head is adapted for rotation about an axis and comprises, at least, one or more chipping knives. Each chipping knife provides at least one pair of linear cutting edges comprising a face cutting edge and a chip cutting edge angled with respect to each other. The face cutting edge defines a planar, face cutting surface of revolution of the cutting head, and the chip cutting edge defines a conical, chip cutting surface of revolution of the cutting head. The face and chip cutting edges of the same chipping knife lie in substantially the same plane.

Preferably, the face and chip cutting edges intersect one another. Preferably, at least portions of both the face and chip cutting edges lie on the same planar surface portion of the knife. Preferably, a chipping knife relationship between the cutting head and the chip cutting edge is at least partially defined by one of (a) a hook angle $\alpha$ in the range $30<\alpha<60$ degrees, and (b) a sweep angle $\beta$ in the range $20<\beta<50$ degrees. Preferably, the chipping knife has a back side and a planar limiting surface extending from the back side to the face cutting edge, and the limiting surface is inclined away from the planar cutting surface by a positive relief angle $\Omega$ which is preferably in the range $1<\Omega<6$ degrees.

A cutting head may in addition or in the alternative include a plurality of facing knives and corresponding clamping members for clamping the facing knives to the cutting head in addition to one or more chipping knives. Each facing knife includes a facing knife-face cutting edge. The facing knives and corresponding clamping members are adapted so that each of the facing knives is removable from the cutting head without removing any of the other of the facing knives.

Preferably, each of the facing knives includes at least one pair of linear cutting edges, where the pair comprises the facing knife-face cutting edge and a facing knife-chip cutting edge angled with respect to the facing knife-face cutting edge. Then, a facing knife relationship between the cutting head and the facing knife-chip cutting edge is at least partially defined by one of (a) a facing knife-hook angle $\alpha$ in the range $45<\alpha<65$ degrees, and (b) a facing knife-sweep angle $\beta$ in the range $40<\beta<56$ degrees.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

DETAILED DESCRIPTION OF PREFERRED EMBODIMENT

Figure 1:
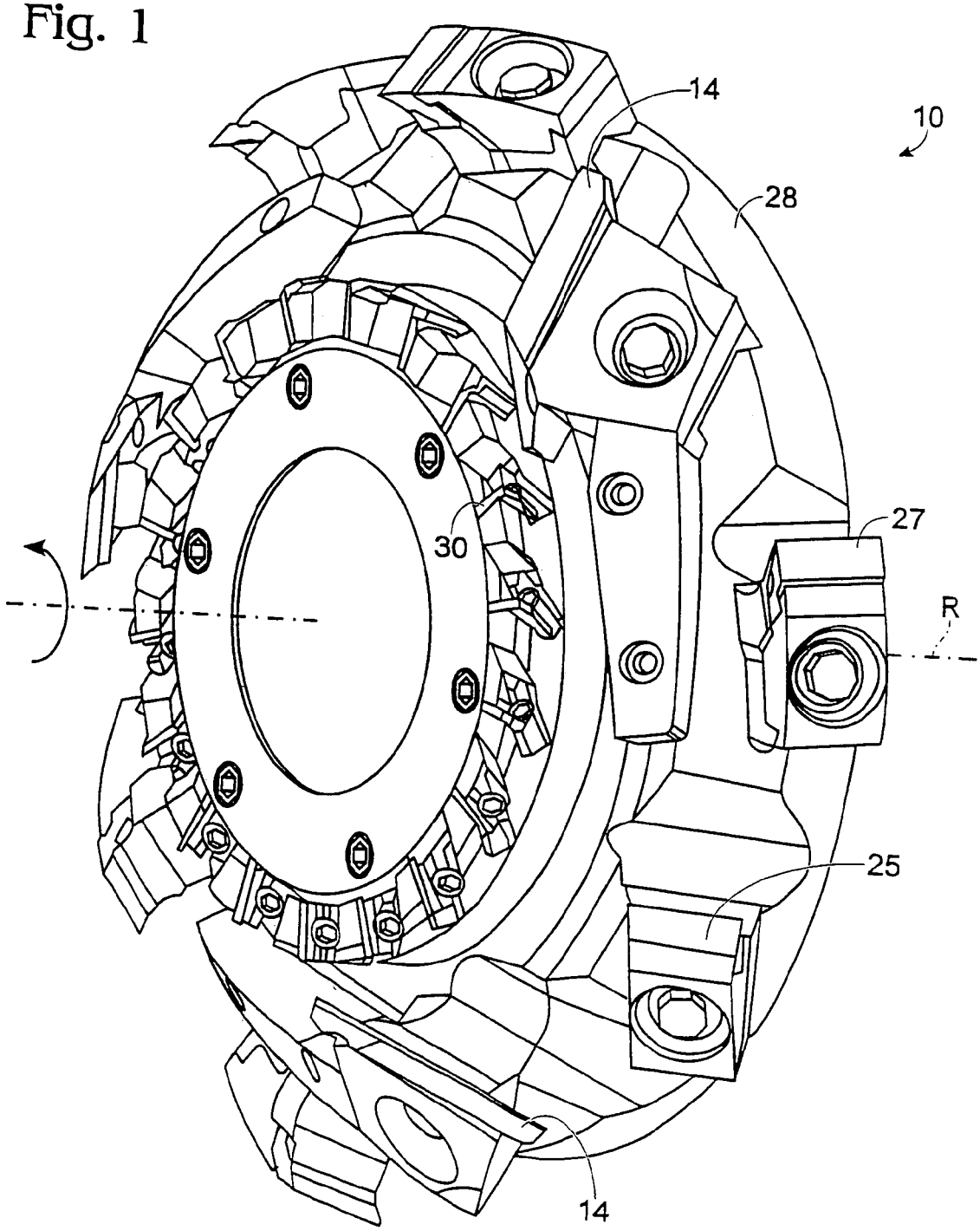
FIG. 1 is a front perspective view of a preferred conical chipper/canter head 10 according to the present invention.

Reference will now be made in detail to specific preferred embodiments of the invention, examples of which are illustrated in the accompanying drawings. Wherever possible, the same reference numbers are used in the drawings and the description to refer to the same or like parts or dimensions.

Conical Head and System

Figure 2:
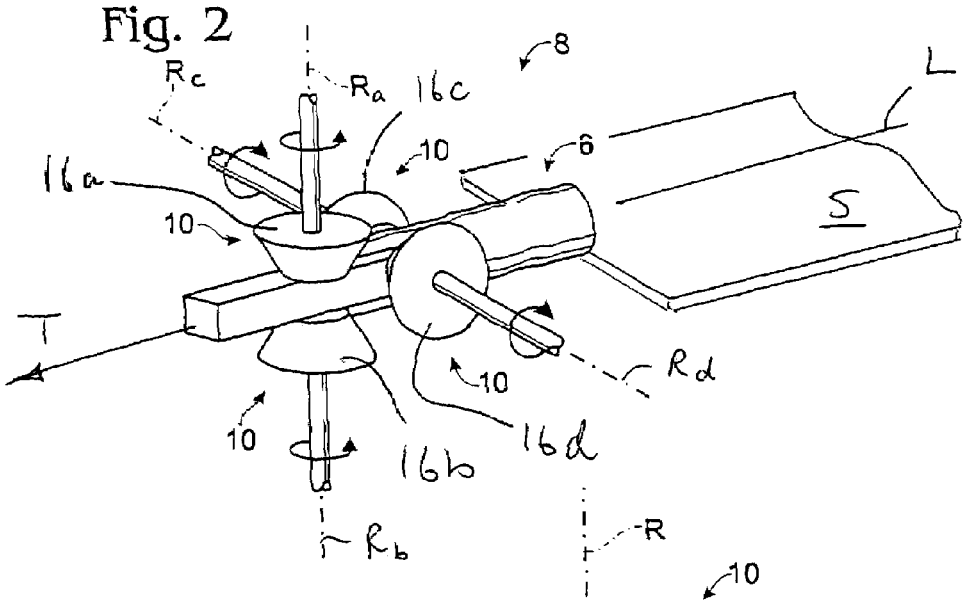
FIG. 2 is a perspective view of a wood cutting system 8 in which four instances of the cutting head of FIG. 1 are provided.

As mentioned above, the present invention relates to a "conical" chipper/canter head ("cutting head"). FIG. 1 shows a preferred cutting head 10 according to the present invention. The cutting head 10 includes a hub 28 carrying a plurality of knives 14 and 30 as will be described below. FIG. 2 shows a wood cutting system 8 in which one or more instances of the cutting head 10 may be used, four orthonormally disposed cutting heads 10 being indicated as would be typical. The system 8 would typically be provided in a sawmill for cutting raw logs, such as the log 6 shown in FIG. 2, and processing the logs into lumber. However, it should be understood that while the cutting head 10 would typically be used for cutting lumber from logs, the cutting head 10 may be used to cut substantially plane surfaces from any other material or object desired.

The system 8 has a table 5 for supporting the log 6, which travels horizontally on the table. As a result of rotation of the cutting heads 10 about respective axes of rotation "R"(the directions shown are arbitrary), in conjunction with travel of the log 6 relative to the cutting heads in a direction "T"aligned with the elongate axis of the log, each cutting head cuts a corresponding planar surface on the log. An object of this process is to produce cut lumber having a surface of high surface quality; however, it is not essential nor typical that the system is used to produce a finished surface.

Figure 3:
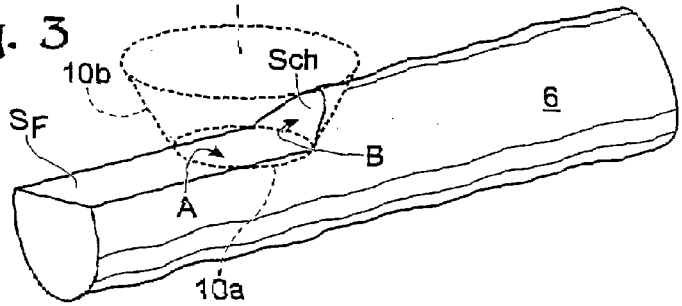
Fig. 3 PRIOR ART
FIG. 3 is a perspective view of the log of FIG. 2 as it is being cut by a typical prior art conical cutting head.

FIG. 3 shows a log as it is being cut by the head 10. The cutting head 10 has a facing portion 10*a* and a chipping portion 10*b*. The facing portion 10*a* produces facing cuts on the log in the region "A" shown in FIG. 3 to produce the substantially planar facing surface "$S_F$," and the chipping portion cuts chips from the log in the region "B," which produces a relatively rough, substantially conically shaped chipped surface "$S_{CH}$."

The "finish" produced by the chipping portion 10*b* has not heretofore been considered important because, as the log translates in relation to the cutting head, any existing surface $S_{CH}$ is immediately obliterated by subsequent chipping and no surface $S_{CH}$ remains on the lumber at the end of the cut. However, as recognized by the present inventors, the chipping portion of the head is also responsible, in part, for the quality of the surface finish produced by the cutting head. Particularly, the transition region between the facing portion of the cutting head, which is parallel to the finished surface of the log, and the chipping portion, which extends outwardly at an angle from this surface, represents essentially a corner of the cutting head that impacts both chipping and facing.

Figure 4:
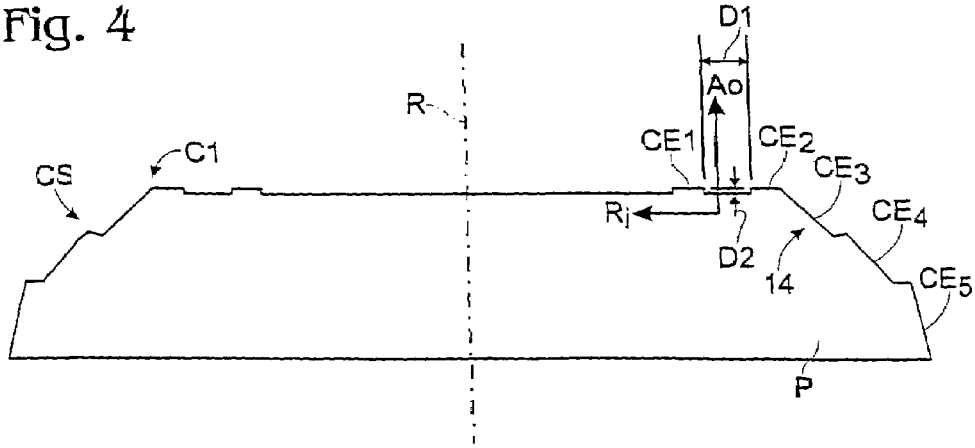
FIG. 4 is a schematic view of the intersection with a facing plane of a three-dimensional surface of revolution produced by the cutting head of FIG. 1.

FIG. 4 shows the intersection, with a plane "P" that is perpendicular to the facing surface "$S_F$" of FIG. 3, of a surface of revolution produced by an instance of the cutting head 10 rotating about its axis of rotation R. As will be explained in more detail below, the cutting head 10 carries a plurality of cutting edges "CE," namely "$CE_1$-$CE_5$." All of the cutting edges CE are provided by knives. As a result of rotation of the cutting edges about the axis R, the cutting head 10 sweeps out a substantially frustoconical cutting surface of revolution "CS" having the contour shown in the plane P. The contour includes a corner "C1."

Figure 5:
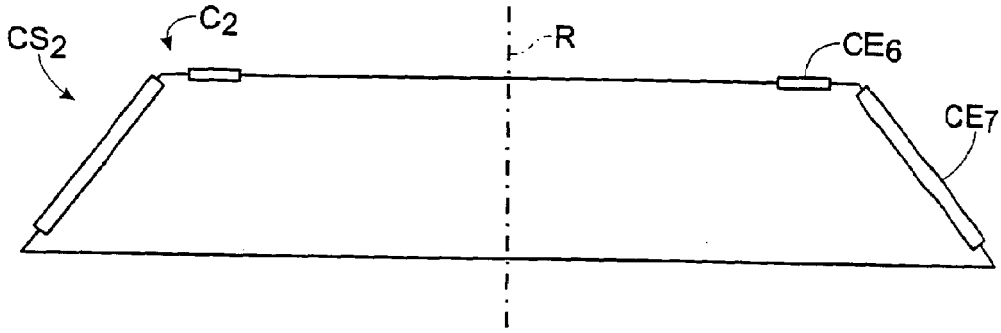
Fig. 5 (PRIOR ART)
FIG. 5 is a schematic view like that of FIG. 4 for a prior art cutting head.

For comparison, FIG. 5 shows the intersection with the plane "P" of a cutting surface of revolution "$CS_2$" about a like axis of rotation R produced by a common prior art cutting head. This cutting head has face cutting edges "$CE_6$" and chip cutting edges "$CE_7$," and the contour of the cutting surface $CS_2$ includes a corner "C2." The chip cutting edges $CE_7$ are provided by a knife, and the face cutting edges $CE_6$ are provided by a disk-saw. This type of prior art cutting head is known to produce a good surface finish.

Figure 6:
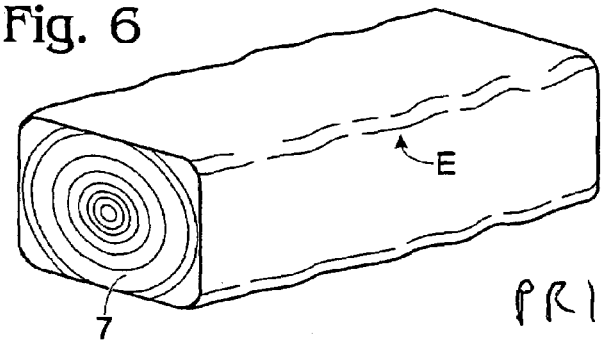
FIG. 6 is a perspective view of a piece of lumber cut from a log cut by the cutting surface of FIG. 5, illustrating "tear-out."

However, it can be seen that there is a gap between the face cutting edges $CE_6$ and the chip cutting edges $CE_7$ at the corner C2. Referring to FIG. 6, showing a piece of lumber 7 cut from a log with this prior art cutting head, this gap has been found by the present inventors to be a contributor to tearing ("tear-out") at edges "E" of the piece. This tear-out impacts the facing surface and reduces its finish quality significantly.

Chipping Knives

Returning to FIG. 4, each of a plurality of chipping knives 14 according to the present invention carried by the cutting head 10 provides a face cutting edge $CE_2$ and a chip cutting edge $CE_3$ that abut one another to produce a sharp cutting corner C1. The sharp cutting corner C1 has been found generally to produce less tear-out than is obtained from the aforedescribed prior art cutting head. However, according to the present invention, tear-out is reduced further as a consequence of angular relationships between the face and chip cutting edges of the knives 14.

The face cutting edge $CE_2$ of a knife 14 defines a planar, face cutting surface portion of the aforementioned cutting surface CS of the cutting head 10, and the chip cutting edge $CE_3$ of the knife defines a conical, chip cutting surface portion of the cutting surface.

Figure 8:
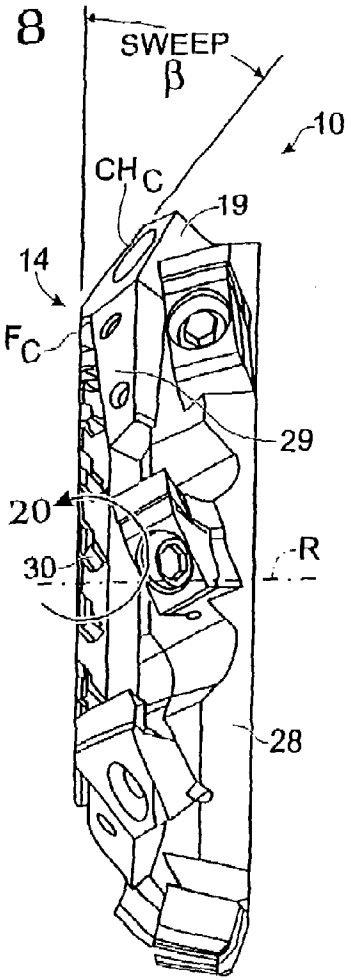
FIG. 8 is a side elevation of the cutting head as shown in FIG. 7, taken along a line 8-8 thereof.
Figure 7:
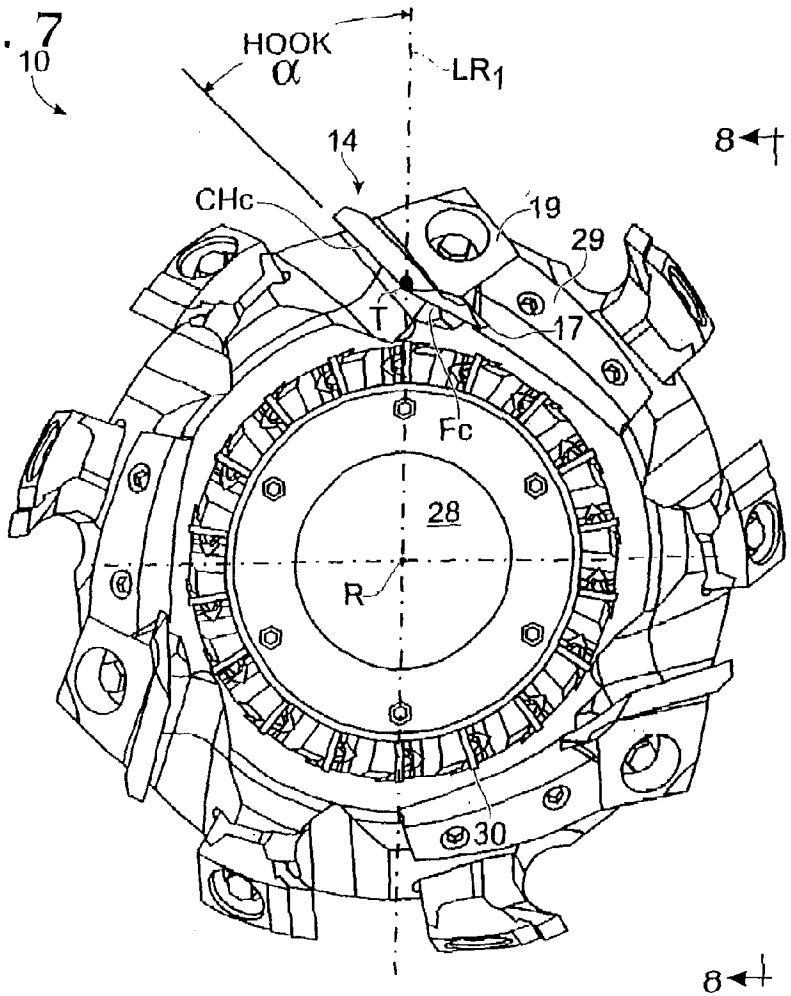
FIG. 7 is a front elevation of the cutting head of FIG. 1, showing relationships between chip cutting knives and the cutting head.

Referring now to FIGS. 7 and 8, the cutting head 10 is shown in front and side elevation, respectively, the former being parallel to, and the latter being perpendicular to, the facing surface $S_F$ of FIG. 3. As best seen in FIGS. 1 and 7, a particular chipping knife 14 is shown clamped by one or more clamping members 19 onto the cutting head 10. The clamping members typically comprise upper and lower portions for clamping the knife between the upper and lower portions, but clamping members may be single portions that clamp the knives directly to the hub 28; details of the clamping members are omitted as such clamps are well known in the art.

Chip Cutting Edges—Hook and Sweep Angles

With reference to FIGS. 7 and 8, the chipping knives 14 are held in the cutting head 10 so that chip cutting edges $CH_C$ define two angles relative to the cutting head. These angles, referred to herein as "hook" angle $\alpha$ and "sweep" angle $\beta$, are recognized in the art as being important parameters in practical use of the cutting head, and it should be understood that they do not depend on the existence of face cutting edges, or the angular relationships between face cutting edges and corresponding chip cutting edges.

The two angles are optimized under an assumption of the relationship between the log being cut and the cutting system 8 shown in FIG. 2, so that they are optimized particularly with respect to the grain orientation relative to the cutting head 10, such as shown in FIG. 2. If the relative grain orientation is changed, modifications to the angles will be desirable.

The hook angle $\alpha$ for a given knife 14 is measured in the plane of FIG. 7 between the projection onto this plane of (a) the (linear) chip cutting edge $CH_C$ of the knife and (b) the like projection of a reference line "$LR_1$" that passes through (1) a tip "T" of the chip cutting edge that is nearest the axis of rotation R of the cutting head, and (2) the axis R. The sweep angle $\beta$ for the knife is measured in the plane of FIG. 8 between the plane of FIG. 7 and the projection onto the plane of FIG. 8 of the chip cutting edge $CH_C$. Preferred ranges for these angles are: $30<\alpha<60$ degrees; $20<\beta<50$ degrees; where optimum values for the hook and sweep angles are 45 and 36 degrees ±2 degrees, respectively.

According to the invention, hook and sweep angles for the chip cutting edges of the knife 14 are selected for the cutting head 10 and are used to define limiting surfaces of the knife that include the face cutting edges, as described below.

Face Cutting Edges—Limiting Surfaces

FIGS. 9-12 show a preferred chipping knife 14 in detail. The knife has a front surface ("FRONT" side) (shown in FIG. 10) and a back surface ("BACK" side) (shown in FIG. 9) surface. The BACK side is generally spaced apart from the FRONT side, but merges with the FRONT side at the face and chip cutting edges of the knife. The knife is preferably "double sided," so that it includes two face cutting edges, here referred to as $F_{C1}$ and $F_{C2}$, and two chip cutting edges, here referred to as $CH_{C1}$ and $CH_{C2}$. Two sets of face and chip cutting edges are provided so that the knife may be removed from the cutting head 10, turned end-for-end, and replaced in the cutting head to expose a fresh pair of the cutting edges.

Figure 10:
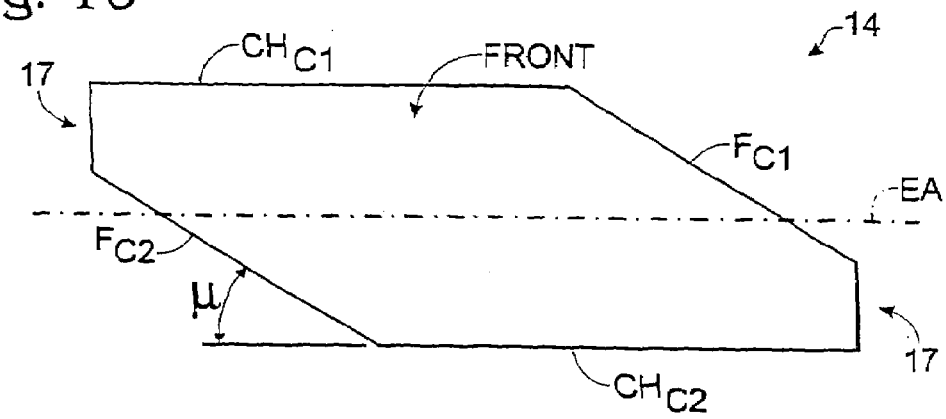
FIG. 10 is a front elevation of the knife of FIG. 9.

Each pair of corresponding face and chip cutting edges are angled with respect to each other (angle $\mu$ in FIG. 10). As a result of considerations discussed below, the angle $\mu$ typically lies in the range $28<\mu<36$. Preferably, the face and chip cutting edges abut one another (e.g., see FIG. 10) or intersect.

The face cutting edge $F_{C1}$ corresponds to and cooperates with the chip cutting edge $CH_{C1}$ and the face cutting edge $F_{C2}$ corresponds to and cooperates with the chip cutting edge $CH_{C2}$.

The FRONT side of the knife incorporates the chip and face cutting edges in its periphery and defines a plane in which these cutting edges lie. While the FRONT side itself is preferably essentially planar, though it preferably has some specific non-planar mating or keying features such as described below, it is not necessary that the FRONT side of the knife have any particular shape. It is also not necessary that the BACK side of the knife have any particular shape, the description below being merely a preferred embodiment.

Figure 13:
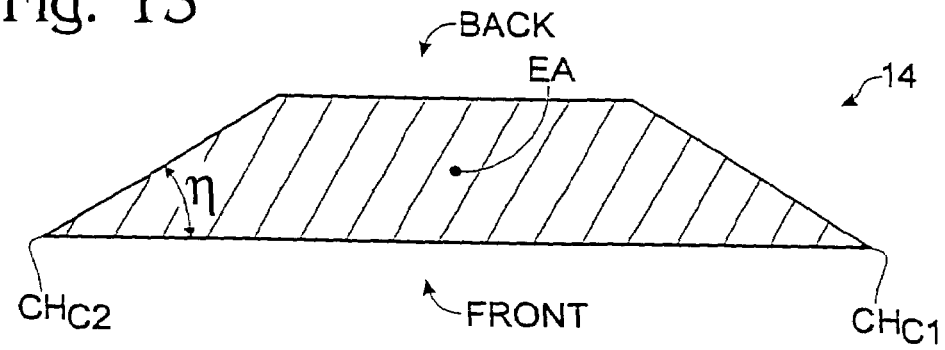
FIG. 13 is a cross-sectional view of the knife of FIG. 9, taken along a line 13-13 thereof.

The BACK side of the knife includes a pair of planar ramping surfaces 20, namely, 20*a*and 20*b*, that extend downwardly from a maximum elevation of the back surface to intersect the FRONT side at corresponding chip cutting edges $CH_{C1}$ and $CH_{C2}$ respectively. Therefore, each ramping surface includes and defines, by intersection with the FRONT side of the knife, a corresponding one of the chip cutting edges $CH_c$. The ramping surfaces also define an acute knife angle $\eta$ with the FRONT side as best seen in FIG. 13. The knife angle $\eta$ is preferably in the range: 31+/−4 degrees.

The BACK side of the knife also includes a pair of planar limiting surfaces S1-LIM and S2-LIM that extend downwardly to intersect the FRONT side at corresponding face cutting edges $F_{C1}$ and $F_{C2}$ respectively. Therefore, each limiting surface includes and defines, by intersection with the FRONT side, a corresponding one of the face cutting edges $F_C$. In addition to so defining the face cutting edges, the limiting surfaces provide stability and control of the log as it is being cut, by limiting the amount the log can bounce or shudder as it is being cut, as a result of interference between the log and the adjacent limiting surface.

Figure 21:
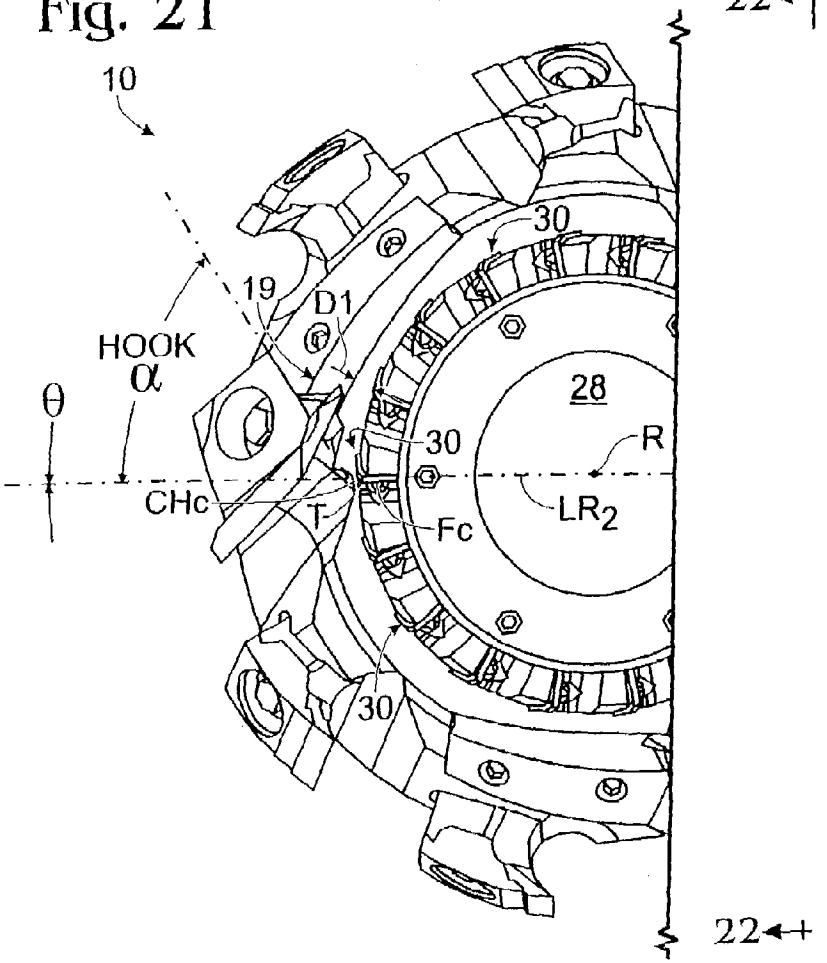
FIG. 21 is a front elevation of the cutting head of FIG. 1 showing relationships between face cutting knives and the cutting head.

The BACK side of the knife 14 preferably still further includes planar corner surfaces 17 that extend downwardly to intersect the FRONT side adjacent the face cutting edges (best seen in FIG. 21 on the knife 14 as installed in the device 10). The corner surfaces are obtusely angled with respect to the face cutting edges and are approximately perpendicular to the chip cutting edges. The corner surfaces 17 define cropped corner sections of the knife which provide additional space for chip flow, decreasing chip flow resistance during operation of the head 10.

Establishing the Limiting Surfaces

The limiting surfaces S1-LIM and S2-LIM are angled with respect to the FRONT side of the knife and with respect to the chip cutting edges $CH_C$ according to the selected hook and sweep angles described above, as follows.

Figure 11:
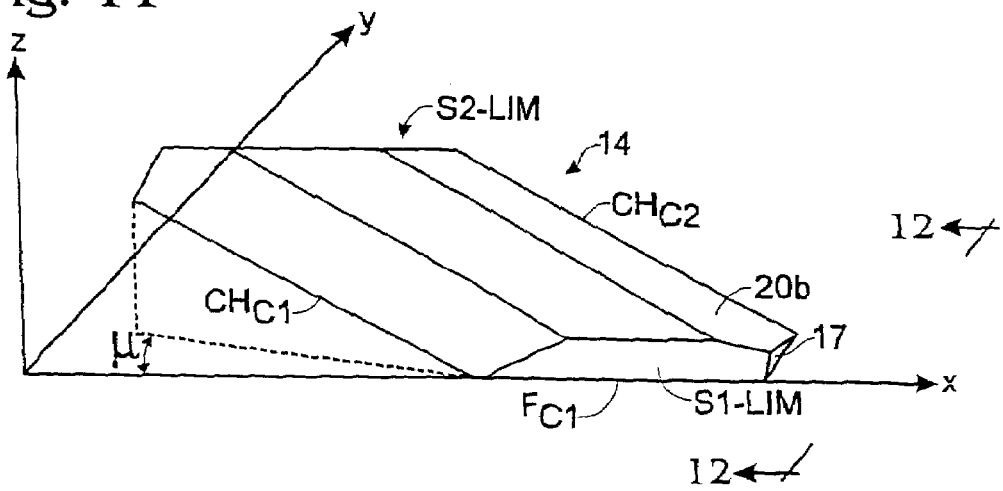
FIG. 11 is a back perspective view of the knife of FIGS. 9 and 10.
Figure 12:
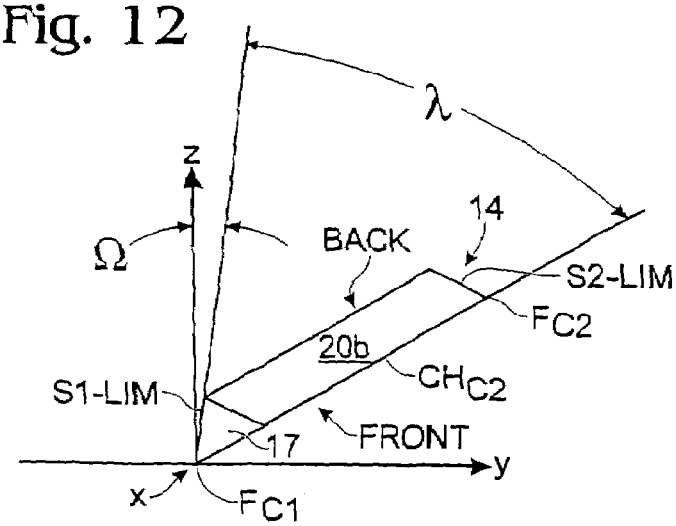
FIG. 12 is a side elevation of the knife of FIG. 11 taken along a line 11-11 thereof.

FIGS. 11 and 12 show the preferred chipping knife 14 with respect to a Cartesian coordinate system having "x," "y," and "z" axes. FIG. 12 shows the knife of FIG. 11 looking down the x-axis. As an aid for comparing the two views, the same ramping surface portion 20*b* of the back surface of the knife is shown in both FIGS. 11 and 12.

As seen in FIG. 11, the face cutting edge $F_{C1}$ lies on the "x" axis of this coordinate system, which lies in a "cutting plane" that is parallel to the plane of FIG. 7, so that the face cutting edge $F_{C1}$ defines a face cutting surface portion of the cutting surface CS referred to above. It may be noted for reference that the chip cutting edge $CH_{C1}$ extends upwardly (in the "z" direction—angle $\lambda$ in FIG. 12) and backwardly (in the "y" direction—angle $\mu$ in FIG. 11) with respect to the face cutting edge to produce the hook and sweep angles indicated above.

The limiting surface S1-LIM is established so as to lie nearly in the aforementioned cutting plane, except that it is pivoted about the face cutting edge $F_C$ backwardly into the plane of FIG. 7 by a relief angle $\Omega$ (positive in the "y" direction of FIG. 11) that is preferably in the range: $1<\Omega<6$ degrees; where the optimum value for the angle $\Omega$ is 2+/−1 degrees.

It should be understood that the limiting surfaces S1-LIM and S2-LIM are mirror images of one another so that the orientation of one limiting surface specifies that of the other.

As a result of considerations discussed above, the limiting surfaces form acute angles $\lambda$ with respect to the FRONT side of the knife, as shown in FIG. 12. Typically, the angle $\lambda$ will range as: $59<\lambda<67$ degrees.

Preferred Construction

Figure 14:
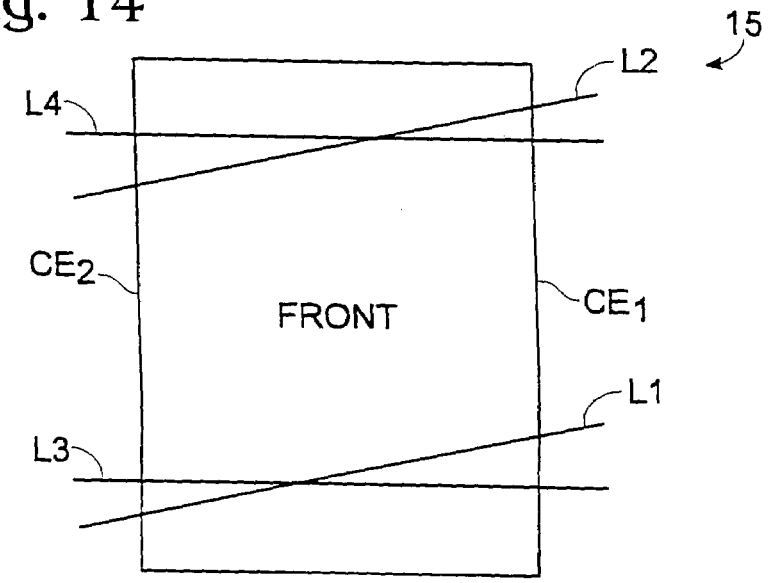
FIG. 14 is a front elevation of the knife of FIG. 13.

Referring back to FIG. 10, the face cutting edges $F_C$ are obliquely angled (angle $\mu$) with respect to the elongate axis EA and the chip cutting edges $CH_{C1}$ and $CH_{C2}$. However, FIG. 13 shows a cross-section of the knife 14, taken along an axis that is perpendicular to the elongate axis and the chip cutting edges. Referring to FIG. 14, this same cross-section may be provided by any suitable existing knife or blank 15 having two cutting edges "$CE_1$" and "$CE_2$" corresponding to the chip cutting edges $CH_{C1}$ and $CH_{C2}$. While it is not essential, the knife 14 may economically and advantageously be constructed by modifying such a blank 15; in any event, this provides a useful way to visualize the basic form of the knife 14.

Figure 9:
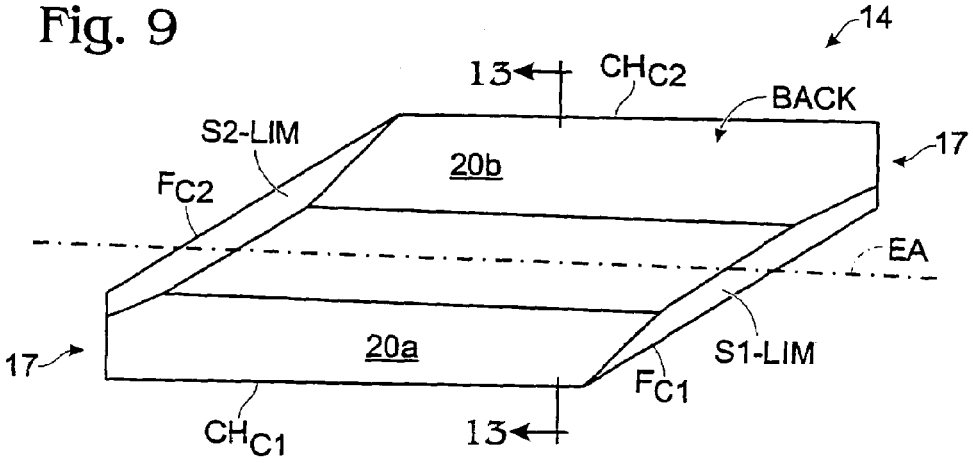
PRIOR ART Fig. 9
FIG. 9 is back perspective view of a chipping knife of the cutting head of FIG. 1 according to the present invention.

The knife 15 is preferably modified according to the invention by cutting the knife 15 along first planes that intersect the FRONT side at lines "L1" and "L2" to form the limiting surfaces S1-LIM and S2-LIM seen together in FIG. 9.

As a result, the knife 14 has a single FRONT side defining along its edges two pairs of chip and face cutting edges. Providing the desired chip and face cutting geometry so that the chip and face cutting edges both lie in the same plane allows incorporating both edges in a knife of minimum size that can also be manufactured very economically. In addition, the clamping members 19 are simplified, so that removal and replacement of the knives is facilitated, and there are reduced costs for repair, maintenance, and storage of replacement parts.

Though not essential, the knife 15 is preferably further modified by cutting the knife along second planes that intersect the FRONT side at lines "L3" and "L4" to form the cropped corner surfaces 17. It will be appreciated in view of the foregoing discussion and FIGS. 9 and 12 in particular that the first planes are not quite perpendicular to the FRONT of the knife 15, each being angled from the perpendicular by the relief angle $\Omega$. The second planes, however, preferably are perpendicular to the FRONT side of the knife.

It will be readily appreciated by persons of ordinary skill in view of the foregoing that, in general, any desired knife cross-section can be established and a suitable blank providing that cross-section in planes perpendicular to an elongate axis of the blank, over a sufficient length, may be used in the manner described above to provide a chipping knife according to the present invention.

Additional Features

Figure 17:
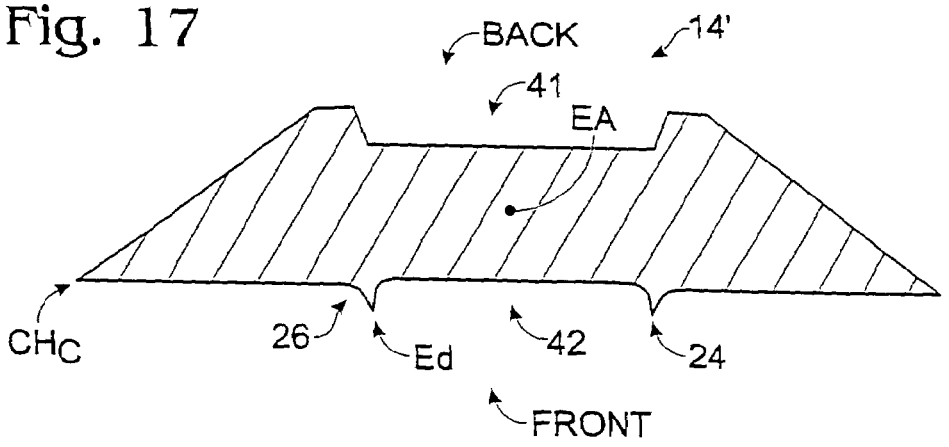
FIG. 17 is a cross-section of the knife of FIG. 16, taken along a line 17-17 thereof.
Figure 15:
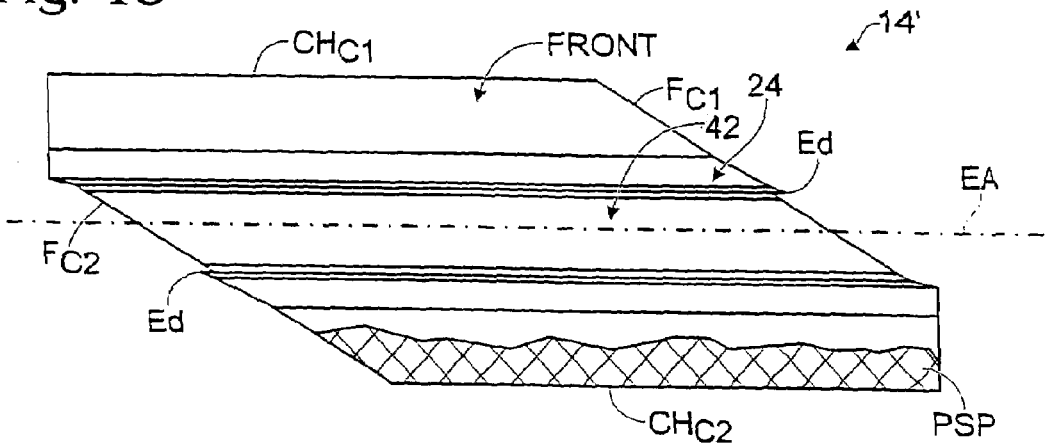
FIG. 15 is a front perspective view of an alternative embodiment of a knife of the cutting head of FIG. 1, corresponding to FIG. 10.
Figure 16:
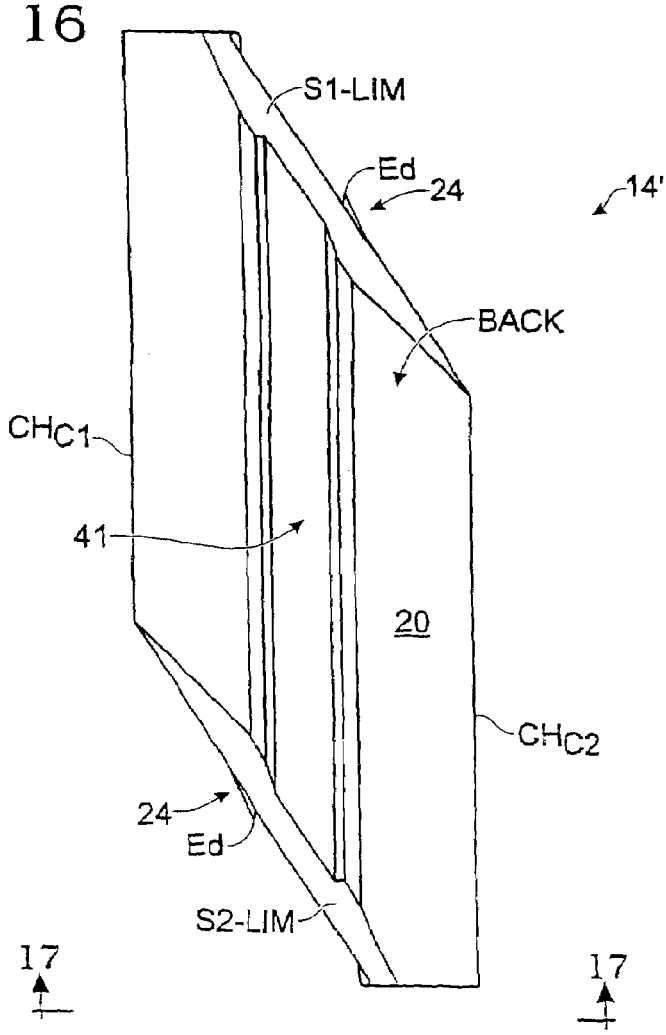
FIG. 16 is a back perspective view of the knife of FIG. 15.

Turning to FIGS. 15-17, a preferred chipping knife 14' according to the present invention is shown. For reference, FIG. 15 corresponds to FIG. 10 for the knife 14, and FIG. 16 corresponds to FIG. 9 for the knife 14. The knife 14' differs from the knife 14 in that the knife 14' includes mating or keying features for indexing the knife to the clamping members 19 and for maintaining exact positions of the knives during use of the cutting head against the very large cutting forces encountered.

For this purpose, preferably, the FRONT side of the knife includes a pair of spaced apart "deflector ridges" 24 that extend outwardly from the FRONT of the knife, running parallel to an elongate axis "EA" of the knife. Such deflector ridges are described in Schmatjen, U.S. Pat. No. 5,819,826, incorporated by reference herein in its entirety. The deflector ridges each have concavely curved outer side surfaces 26 (FIG. 17) terminating in respective sharp linear edges "Ed." The deflector ridges serve at least two purposes. First, they provide for a smooth transition for guiding the flow of chips cut by the chip cutting edges $CH_C$; second, the deflector ridges define between them effectively a FRONT-side recess 42 that can be used to index and positively hold the knife to a lower or counter-knife portion of the clamping members 19, or directly to the cutting head 10, in a stable position. The same features could be provided by alternative configurations of the deflector ridges; for example, they need not be adapted to provide both of the aforedescribed functions, and an equivalent of the recess 42 could be provided by a keyway.

Preferably the knife 14' also includes a modified "V" shaped BACK-side recess 41 that is used to index to an upper portion of the clamping members 19 and positively hold the knife in place.

Preferably, the FRONT side of the knife 14' remains essentially planar like the knife 14, apart from the inclusion of the deflector ridges 24, so that at least portions of both the face and chip cutting edges lie in a common planar surface portion of the knife. For example, FIG. 15 shows a planar surface portion "PSP" (shown cross-hatched) of the FRONT side of a knife 14' that includes non-planar features (24) extending from an otherwise planar FRONT side. The identified surface portion PSP is planar and includes a portion of a face cutting edge $F_{C2}$ as well as the entirety of a chip cutting edge $CH_{C2}$.

Figure 18:
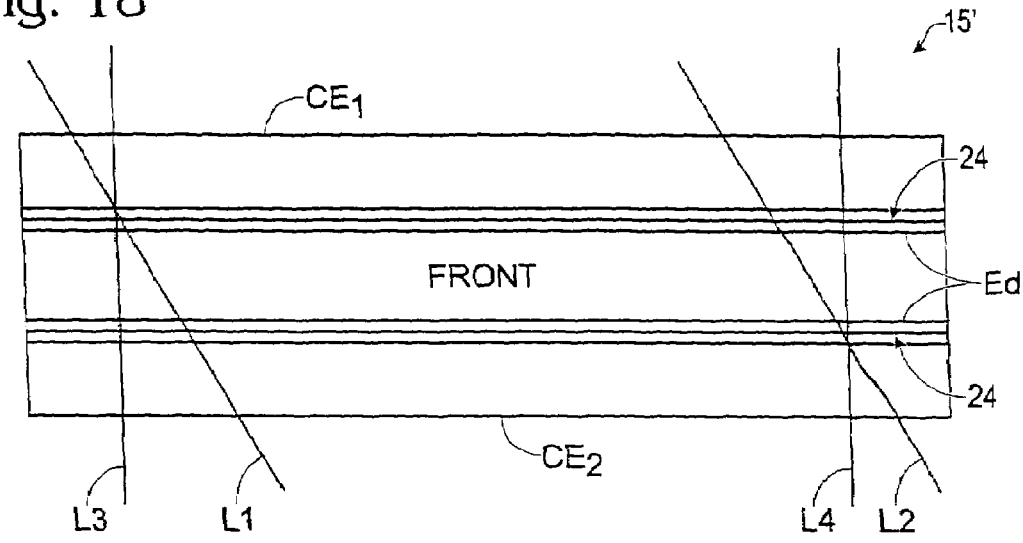
FIG. 18 is a bottom view of a preferred prior art knife, showing cutting lines for modifying the knife according to the present invention.

The chipping knife 14' has the cross-section shown in FIG. 17, corresponding to that shown in FIG. 13 for the knife 14. This is the same cross-section as is provided in a preferred prior art knife 15', shown in FIG. 18, that is manufactured and marketed by the assignee, Key Knife, Inc., of Tualatin, Oreg.

The knife 15' is a double-sided knife having two cutting edges "$CE_1$" and "$CE_2$" and a pair of deflector ridges 24. As the for the blank 15, the knife 15' may be modified by cutting the knife 15' along first planes that intersect the FRONT side at lines "L1" and "L2" to form the limiting surfaces S1-LIM and S2-LIM seen together in FIG. 16, and cutting the knife along second planes that intersect the FRONT side at lines "L3" and "L4" to form the cropped corner sections 17.

As can be seen in FIGS. 16 and 17, the deflector ridges 24 of the knife 15' cut to produce the knife 14 remain extending from the otherwise linear face cutting edge $F_C$ of the knife 14. It may appear that these features would compromise cutting quality or cutting efficiency. However, the present inventors have determined that this is not so. Therefore, additional manufacturing savings can be realized because the face cutting edge $F_C$ need not be finished by removing the deflector ridges in the vicinity of the cutting edge $F_C$ as an additional manufacturing step. Avoiding this finishing has the additional advantage that, if removal is not accomplished judiciously, such may impair the knife's surface finishing capability.

Additional Chipping Knives

Turning back to FIGS. 1 and 4, secondary chipping knives 25 are preferably provided by the cutting head 10. With particular reference to FIG. 4, the secondary knives correspond to the cutting edges $CE_4$, which overlap a portion of the cutting surface (CS) produced by the knives 14 (chip cutting edges $CE_3$). The cutting edges $CE_4$ of the secondary knives 25 are provided at a steeper angle with respect to the horizontal in FIG. 4 than the chip cutting edges $CE_3$ of the knives 14.

Also with reference to FIGS. 1 and 4, tertiary chipping knives 27 are preferably provided by the cutting head 10. With particular reference to FIG. 4, the tertiary knives correspond to the cutting edges $CE_5$, which overlap a portion of the cutting surface (CS) produced by the secondary knives 25 (chip cutting edges $CE_4$). The cutting edges $CE_5$ of the tertiary knives are provided at yet a steeper angle with respect to the horizontal in FIG. 4 than the chip cutting edges $CE_3$ of the knives 14.

Facing Knives

Referring back to FIGS. 7 and 8, it may be noted that the cutting head 10 includes, in addition to the chipping knives 14 and their associated clamping members 19, corresponding limiting members 29 that trail, with respect to the direction of rotation of the head 10, the chipping knives and that have helically contoured surfaces. Analogous to the limiting surfaces of the chipping knives 14, the limiting members 29 provide stability and control of the log as it is being cut, by limiting the amount the log can bounce or shudder as it is being cut, as a result of interference between the log and the limiting members.

Now turning back to FIG. 1, the cutting head 10 further includes a plurality of facing knives 30. The hub 28 of the cutting head 10 carries the facing knives 30 so that the knives are azimuthally (with respect to the axis of rotation) spaced apart, defining a portion of the cutting surface CS of FIG. 4 that is due to the cutting edges $CE_1$ as shown in FIG. 4. This portion is spaced radially inwardly (direction $R_i$ in FIG. 4) and axially outwardly (direction $A_o$) from an adjacent portion defined by the chipping knives 14 that is due to the cutting edges $CE_2$ and $CE_3$. The relative axial displacement "D1" (FIG. 4 and FIG. 20) of these two portions is preferably in the range: 1.0" to 1.5"; where an optimum value is about 1.25". The relative radial displacement "D2" (FIG. 4 and FIG. 21) of the two portions is preferably in the range: 0.020" to 0.125"; where an optimum value is about 0.080".

The facing knives 30 finish the facing surface $S_F$ of FIG. 3 initiated by the face cutting edges $F_C$ of the chipping knives 14. The geometries and configurations described above for the chipping knives 30, their relation to the facing knives 14 as described immediately above, and the geometries and configurations described below for the facing knives 30, all contribute to providing an optimum surface finish according to the invention.

Preferred Clamping

In addition, it is noted that surface finish is a function of the speed of rotation of the cutting head. Increasing the speed of travel of the log without decreasing the speed of rotation of the head will in general decrease the quality of the surface finish, and it is advantageous either to be able to increase the speed while maintaining the quality of surface finish, or maintain the speed and improve the quality of surface finish.

For this purpose, the azimuthally distributed cutting edges of the facing knives 30 are preferably spaced as close together as possible to increase the knife density and, therefore, cutting frequency. However, each facing knife must be removable so the knife can be sharpened, turned, or replaced. According to the present invention, a maximum density of the facing knives 30 is provided while maintaining the ability to easily remove the knives from the cutting head.

Figure 19:
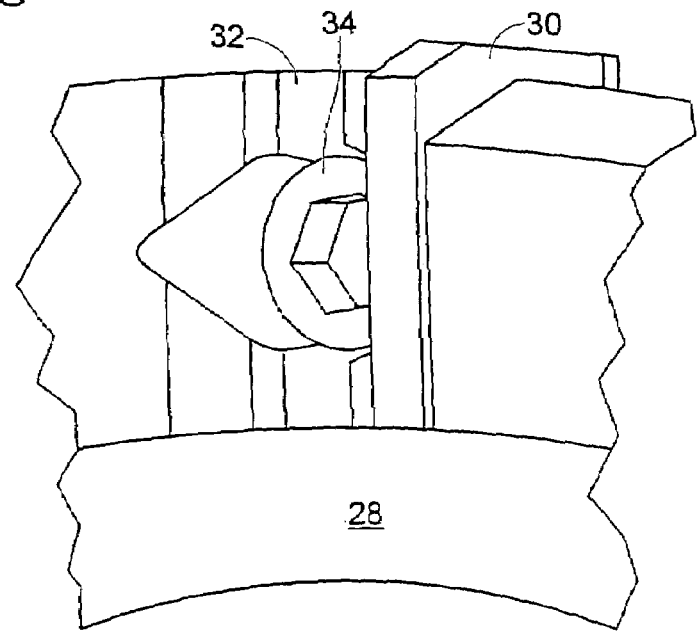
FIG. 19 is a front perspective view of a portion of the cutting head of FIG. 8, taken along a detail circle 19-19 thereof, showing facing knives and a clamping arrangement therefor according to the present invention.
Figure 20:
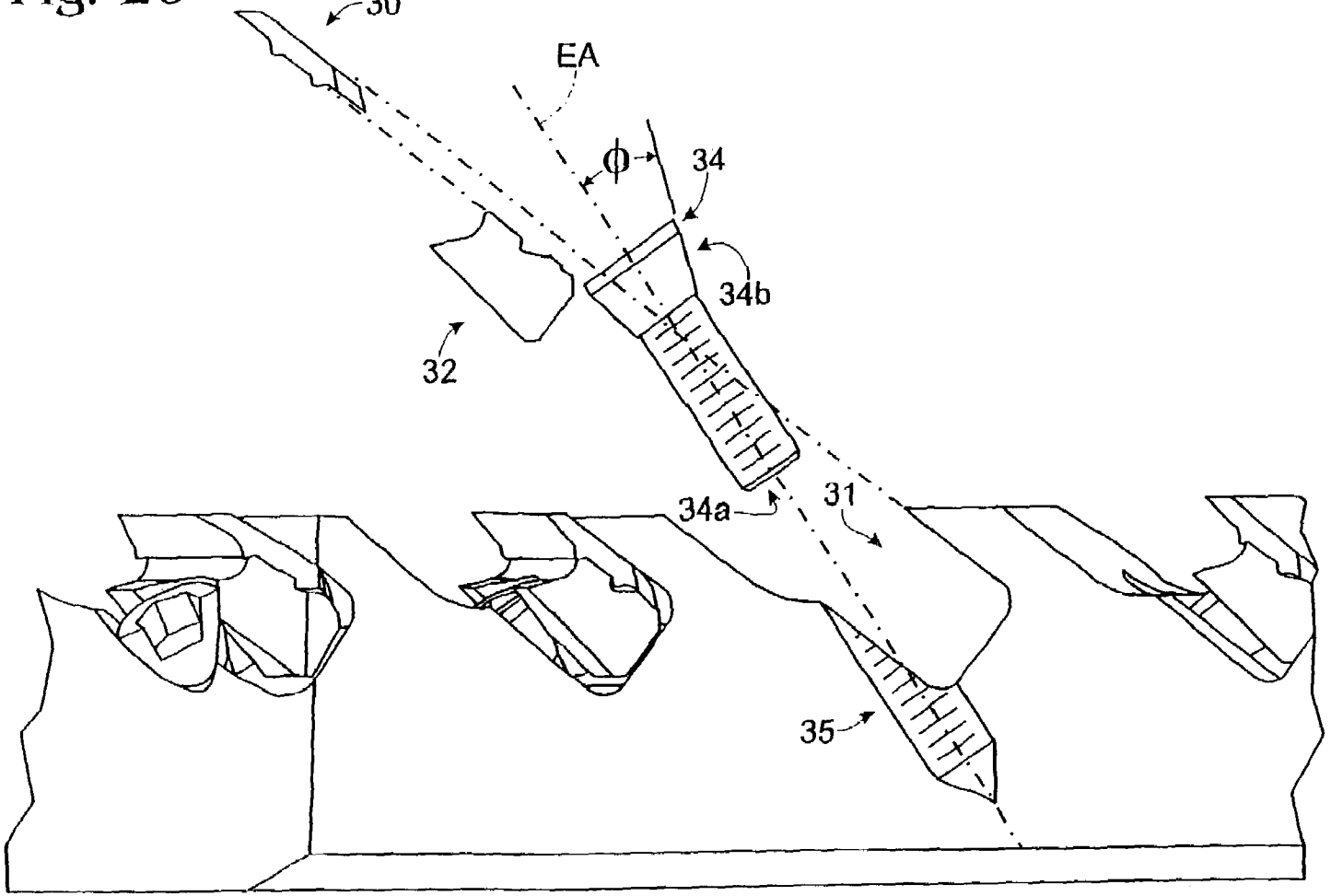
FIG. 20 is an exploded side elevation view of a portion of the cutting head of FIG. 1, showing a knife and clamping arrangement therefor in accord with FIG. 19.

Turning now to FIGS. 19 and 20 showing, respectively, a portion of the hub 28 as seen in the face cutting plane and in a plane perpendicular, each facing knife is 30 is preferably disposed in an associated pocket 31 and has an associated gib 32. As best seen in FIG. 20, showing parts exploded, a screw 34 has a threaded portion for threading into a hole 35 in the hub. The threaded portion terminates in a terminating end 34*a* that is, preferably, contained within the hub and, in any event, is not used to exert a force on either the gib or the knife. Rather, the screw 34 according to the present invention has a ramping shoulder portion 34*b* which in a preferred embodiment of the invention is frustoconical in shape. The ramping portion 34*b* exerts increasing wedging force against the gib 32 as the screw is tightened, the gib in turn transmitting this wedging force against the knife, to clamp the knife in place against a supporting wall 31*c* of the pocket 31.

An angle $\phi$ defines a ramp angle of the ramping portion 34*b* of the screw 34. This ramp angle provides a mechanical advantage in translating a tightening force applied to thread the screw into the hole 35 into a clamping force bearing against the gib and, in turn, the knife. A small ramp angle $\phi$ increases the advantage; however, if the ramp angle is too small, too little range of movement of the gib will be provided to accommodate manufacturing tolerances between the screw, gib and knife, along with the additional elastic compression of the parts necessary to exert the required clamping force. It has been found that the ramp angle $\phi$ is preferably in the range of about 10-25 degrees.

The screw and gib provide minimum sized components for clamping knives with maximum clamping security, contributing to maximum knife density. Also contributing to this density, the screw 34 may be accessed from essentially an axial direction, by threading and un-threading the screw in the direction of the cylindrical axis "EA" of the hole 35, rather than in an azimuthal direction requiring more spacing between the knives to provide for access. Moreover, the improved surface finish can be traded off, to any extent desired, to achieve higher production throughput by increasing the speed of travel of the log being cut.

The screw 34 is shown with a female cap 34*c* adapted for coupling with a male threading or tightening tool, such as an Allen wrench; however, it may include a male cap for use with a female tool, such as an open end wrench. An advantage of a male cap is that it will not tend to become loaded with wood waste during operation, while an advantage of the female cap is that it provides for greater clearance and, hence, potentially an even greater knife density.

Preferred Angular Relationships: Cutting Head and Chipping Knives

Figure 22:
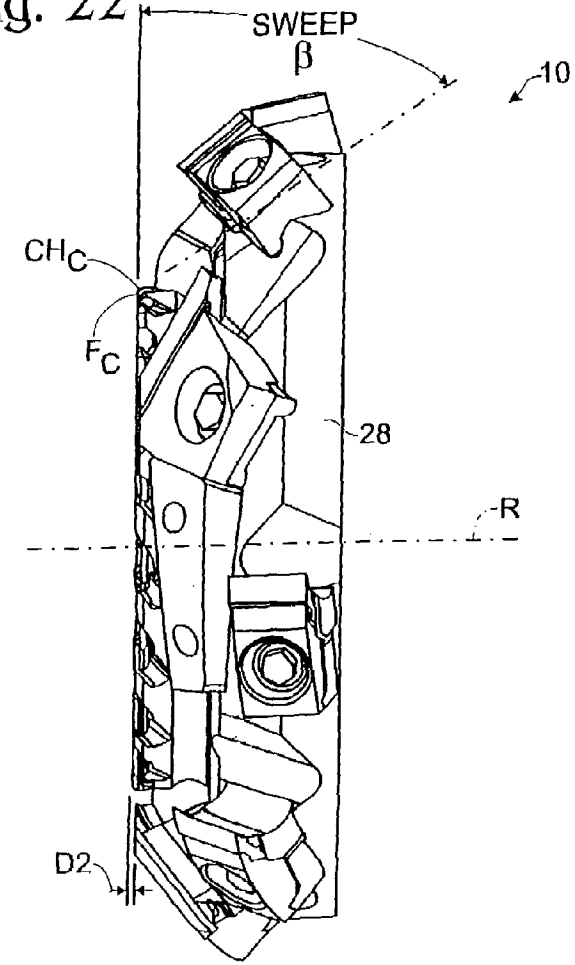
FIG. 22 is a side elevation of the cutting head as shown in FIG. 21, taken along a line 22-22 thereof.

FIGS. 21 and 22 illustrate some preferred angular relationships between the chip and face cutting edges $CH_C$ and $F_C$ of the facing knives 30 and the cutting head 10. FIGS. 21 and 22 reproduce the head 10 as it is seen in FIGS. 7 and 8, showing the analogous angular relationships for the cutting edges of the chipping knives 30. These relationships result from a combination of the configuration of the knife and the clamping arrangement employed, which is preferably the aforedescribed screw 34 and gib 32 but which may be any other clamping system or arrangement desired.

The angles are optimized herein under the assumption of the relationship between the log being cut and the cutting system 8 shown in FIG. 2, so that they are optimized particularly with respect to the grain orientation relative to the cutting head 10. Persons of ordinary skill will readily appreciate, therefore, that if the relative grain orientation is changed, modifications to the optimized relationships discussed below will be desirable.

It is recognized herein that, as for the knives 14, the angular relationship between the cutting head 10 and the chip cutting edge $CH_C$ of the facing knives 30 may be defined by a hook angle $\alpha$ and a sweep angle $\beta$. The hook angle $\alpha$ for a given knife 30 is measured in the plane of FIG. 20 between the projection onto this plane of (a) the (linear) chip cutting edge $CH_C$ of the knife and (b) the like projection of a reference line "$LR_2$" that passes through (1) a tip "T" of the chip cutting edge that is nearest the axis of rotation R of the cutting head, and (2) the axis R.

The sweep angle $\beta$ for the knife 30 is measured in the plane of FIG. 22 between the plane of FIG. 21 and the projection onto the plane of FIG. 22 of the chip cutting edge $CH_C$ of the knife. Preferred ranges for these angles are: $45<\alpha<65$ degrees; $40<\beta<56$ degrees; where optimum values for the hook and sweep angles are 55 and 48 degrees, +/−2 degrees, respectively.

Referring back to FIG. 21, like the hook angle $\alpha$ for the chip cutting edges $CH_C$, the face cutting edges $F_C$ of the knife 30 also defines an angle $\theta$ in the plane of the Figure, which (like the hook angle) defines an angle of attack for the cutting head 10. The face cutting edge $F_C$ lies in the plane of FIG. 21 and the angle $\theta$ is measured between this edge and the reference line $LR_2$. The angle $\theta$ is preferably 0 degrees +/−2 degrees.

Preferred Facing Knife in Detail

Figure 23:
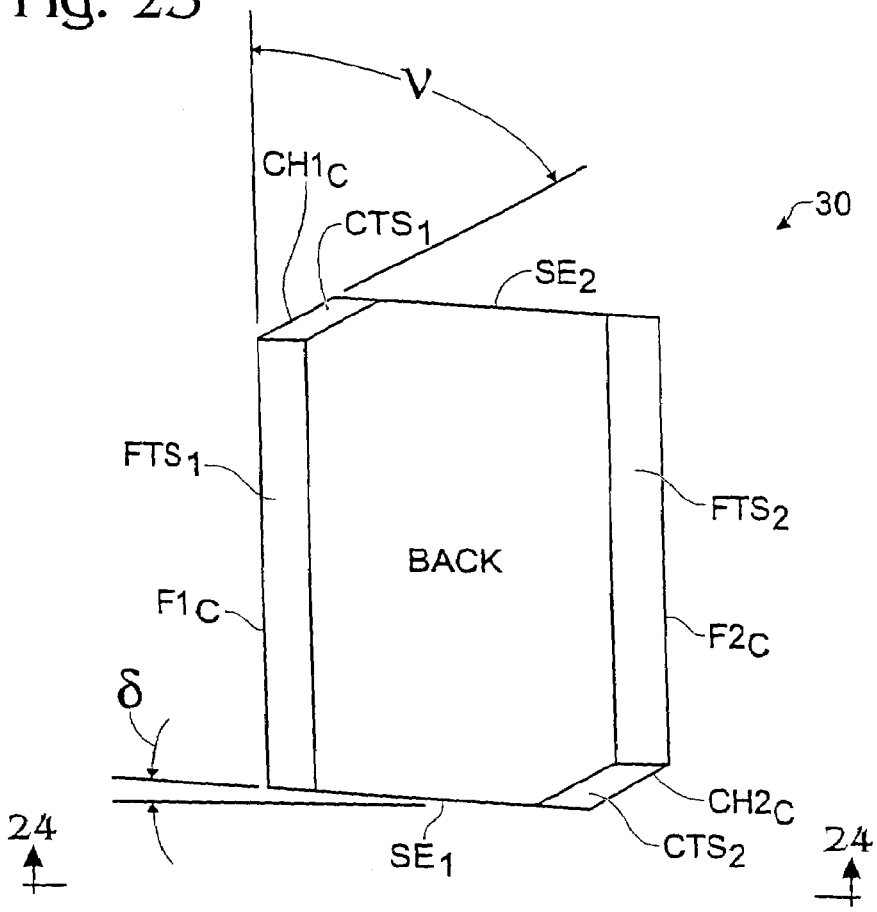
FIG. 23 is a back elevation of the knife of FIGS. 19 and 20.
Figure 24:
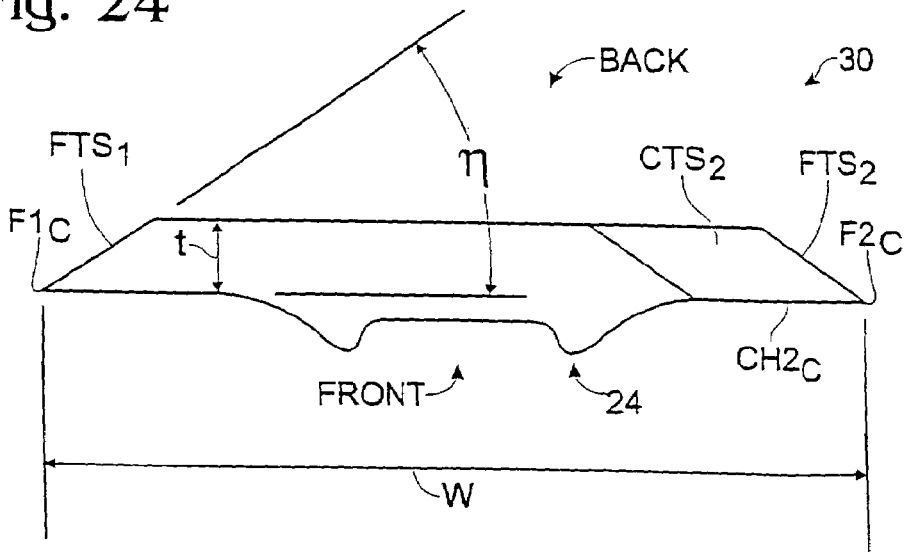
FIG. 24 is a side elevation of the knife of FIG. 21, viewed along the line 24-24 thereof.

Turning to FIGS. 23 and 24, the facing knife 30 has a front ("FRONT") (shown in FIG. 23) and an opposed (parallel) back ("BACK") (shown in FIGS. 23 and 24) surface. It is preferably "double sided," having two face cutting edges $F_C$, namely $F\mathbf{1}_C$ and $F\mathbf{2}_C$, so that it can be turned end-for-end for doubling use. Preferably, extending from the FRONT of the knife 30 are two deflector ridges 24 extending parallel to the face cutting edges, like those described above for the knife 14 and providing the same functions.

The face cutting edges $F\mathbf{1}_C$ and $F\mathbf{2}_C$ of the knife 30 perform essentially the same functions as the corresponding face cutting edges $F_{C1}$ and $F_{C2}$ of the knife 14 but produce a higher degree of surface finish because each knife 30 cuts less material. This is true for three reasons. First, the knives 30 work the relatively smooth surface already created by the knives 14 (compare the relative disposition of the cutting edges $CE_1$ and $CE_2$ in FIG. 4). Second, there are preferably more of the knives 30 than the knives 14. Third, the knife 30 is relatively small compared to the knife 14. FIGS. 23 and 24 are drawn substantially to scale in a preferred embodiment, a representative width dimension "W" (FIG. 23) for the knife 30 being about ⅞" (about 22 mm). The face cutting edges of the knives 30 are preferably less than half the length of the face cutting edges of the knives 14.

Also analogous to the knife 14, the knife 30 preferably includes "chip" cutting edges $CH_C$, namely "$CH1_C$" and "$CH2_C$," corresponding respectively to the face cutting edges $F\mathbf{1}_C$ and $F\mathbf{2}_C$, which function similarly to the chip cutting edges $CH_{C1}$ and $CH_{C2}$ of the knife 14, except that the material cut by these very small "chip" cutting edges is sawdust rather than chips. It has been found that, absent the "chip" cutting edges, corners of the face cutting edges $F\mathbf{1}_C$ and $F\mathbf{2}_C$ will tend to peel off surface material in strips as a result of translating the log with respect to the cutting head. Each chip cutting edge $CH_C$ is defined by the meeting or linear intersection of two substantially planar surfaces, i.e., the FRONT side of the knife and a chip transition surface portion CTS ($CTS_1$ and $CTS_2$) of the BACK side of the knife.

The preferred angular relationship between the face cutting edge and the chip cutting edge is defined by an angle $\nu$ in the range $54<\nu<68$ degrees; where an optimum value for the angle $\nu$ is 62+/−4 degrees. It may be noted that the angle $\nu$ of the facing knives 30 corresponds to the angle $\mu$ of the chipping knives 14, the angle corresponding to $\lambda$ being zero.

A relief angle $\delta$ (FIG. 23) for the facing knife 30 defined between a planar side end surface SE ($SE_1$ or $SE_2$) adjacent the cutting edge $F_C$, and not including the chip cutting edge $CH_C$, and the cutting edge $F_C$. The relief angle $\delta$ is preferably in the range: $1<\delta<6$ degrees; where the optimum value for the angle $\delta$ is 2+/−1 degrees.

Each face cutting edge $F_C$ is defined by the meeting or linear intersection of two substantially planar surfaces, i.e., the FRONT side of the knife and a face transition surface portion FTS ($FTS_1$ and $FTS_2$) of the BACK side of the knife. A knife angle $\eta$ (FIG. 24) for the knife defined between the FRONT side and the transition surface TS is preferably in the range: $34<\eta<40$ degrees; where the optimum value for the angle $\eta$ is 37+/−1 degrees.

The knives 30 may and preferably are made very thin (dimension "t" in FIG. 22), and are small enough that they may economically be provided as disposable parts. The ability to make the knives thin is due, at least in part, to the security of the clamping force provided by the screw 34 as well as the indexing provided by the deflector ridges.

It will be readily appreciated that the facing knife 30 may be formed in a manner similar to that described above for the chipping knife 14.

It is to be understood that, while a specific conical chipper/canter head has been shown and described as preferred, other configurations and methods could be utilized, in addition to those already mentioned, without departing from the principles of the invention. While such cutting heads preferably include both chipping and facing knives according to the invention, either may be provided independently. While the preferred knives described herein employ deflector ridges as shown and as described in the '826 Patent, other keying, interlocking, or otherwise cooperating features for locating, indexing, or increasing the security of clamping of the knives to the cutting head may be employed or omitted as desired without departing from the principles of the invention.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A cutting head adapted for rotation about an axis, comprising one or more elongate chipping knives mounted to the cutting head, each said chipping knife having an elongate axis, a face cutting edge and a chip cutting edge, said face cutting edge being oriented so as to cut a planar surface as the cutting head rotates about said axis, and said chip cutting edge being oriented so as to cut a conical surface as the cutting head rotates about said axis, said face and chip cutting edges lying in substantially the same plane parallel to the associated elongate axis.

2. The cutting head of claim 1, wherein said face and chip cutting edges intersect one another.

3. The cutting head of claim 2, wherein at least portions of both said face and chip cutting edges lie on the same planar surface portion of the knife.

4. The cutting head of claim 1, wherein at least portions of both said face and chip cutting edges lie on the same planar surface portion of the knife.

5. The cutting head of claim 4, wherein a chipping knife relationship between the cutting head and said chip cutting edge is at least partially defined by one of (a) a hook angle $\alpha$ in the range $30<\alpha<60$ degrees, and (b) a sweep angle $\beta$ in the range $20<\beta<50$ degrees.

6. The cutting head of claim 3, wherein a chipping knife relationship between the cutting head and said chip cutting edge is at least partially defined by one of (a) a hook angle $\alpha$ in the range $30<\alpha<60$ degrees, and (b) a sweep angle $\beta$ in the range $20<\beta<50$ degrees.

7. The cutting head of claim 2, wherein a chipping knife relationship between the cutting head and said chip cutting edge is at least partially defined by one of (a) a hook angle $\alpha$ in the range $30<\alpha<60$ degrees, and (b) a sweep angle $\beta$ in the range $20<\beta<50$ degrees.

8. The cutting head of claim 1, wherein a chipping knife relationship between the cutting head and said chip cutting edge is at least partially defined by one of (a) a hook angle $\alpha$ in the range $30<\alpha<60$ degrees, and (b) a sweep angle $\beta$ in the range $20<\beta<50$ degrees.

9. The cutting head of claim 8, wherein said chipping knife relationship is at least partially defined by said hook angle.

10. The cutting head of claim 9, wherein said chipping knife relationship is at least partially defined by said sweep angle.

11. The cutting head of claim 8, wherein said chipping knife relationship is at least partially defined by said sweep angle.

12. The cutting head of claim 8, wherein said chipping knife has a back side and a planar limiting surface extending from said back side to said face cutting edge, wherein said limiting surface is inclined away from said planar cutting surface by a positive relief angle $\Omega$.

13. The cutting head of claim 12, wherein said relief angle is in the range $1<\Omega<6$ degrees.

14. The cutting head of claim 10, wherein said chipping knife has a back side and a planar limiting surface extending from said back side to said face cutting edge, wherein said limiting surface is inclined away from said planar cutting surface by a positive relief angle $\Omega$.

15. The cutting head of claim 9, wherein said chipping knife has a back side and a planar limiting surface extending from said back side to said face cutting edge, wherein said limiting surface is inclined away from said planar cutting surface by a positive relief angle $\Omega$.

16. The cutting head of claim 8, wherein said chipping knife has a back side and a planar limiting surface extending from said back side to said face cutting edge, wherein said limiting surface is inclined away from said planar cutting surface by a positive relief angle $\Omega$.

17. The cutting head of claim 7, wherein said chipping knife has a back side and a planar limiting surface extending from said back side to said face cutting edge, wherein said limiting surface is inclined away from said planar cutting surface by a positive relief angle $\Omega$.

18. The cutting head of claim 6, wherein said chipping knife has a back side and a planar limiting surface extending from said back side to said face cutting edge, wherein said limiting surface is inclined away from said planar cutting surface by a positive relief angle $\Omega$.

19. The cutting head of claim 5, wherein said chipping knife has a back side and a planar limiting surface extending from said back side to said face cutting edge, wherein said limiting surface is inclined away from said planar cutting surface by a positive relief angle $\Omega$.

20. The cutting head of claim 4, wherein said chipping knife has a back side and a planar limiting surface extending from said back side to said face cutting edge, wherein said limiting surface is inclined away from said planar cutting surface by a positive relief angle $\Omega$.

21. The cutting head of claim 3, wherein said chipping knife has a back side and a planar limiting surface extending from said back side to said face cutting edge, wherein said limiting surface is inclined away from said planar cutting surface by a positive relief angle $\Omega$.

22. The cutting head of claim 2, wherein said chipping knife has a back side and a planar limiting surface extending from said back side to said face cutting edge, wherein said limiting surface is inclined away from said planar cutting surface by a positive relief angle $\Omega$.

23. The cutting head of claim 1, wherein said chipping knife has a back side and a planar limiting surface extending from said back side to said face cutting edge, wherein said limiting surface is inclined away from said planar cutting surface by a positive relief angle $\Omega$.

24. The cutting head of claim 5, further comprising a plurality of facing knives and corresponding clamping members for clamping said one or more facing knives to the cutting head, each said facing knife including a facing knife-face cutting edge, said clamping members adapted so that each of said plurality of facing knives is clamped to the cutting head independently of the other of said plurality of facing knives.

25. The cutting head of claim 24, wherein each of said facing knives includes at least one pair of linear cutting edges, said pair comprising said facing knife-face cutting edge and a facing knife-chip cutting edge angled with respect to said facing knife-face cutting edge, wherein a facing knife relationship between the cutting head and said facing knife-chip cutting edge is at least partially defined by one of (a) a facing knife-hook angle $\alpha$ in the range $45<\alpha<65$ degrees, and (b) a facing knife-sweep angle $\beta$ in the range $40<\beta<56$ degrees.

26. The cutting head of claim 25, wherein said facing knife relationship is at least partially defined by said facing knife-hook angle.

27. The cutting head of claim 26, wherein said facing knife relationship is at least partially defined by said facing knife-sweep angle.

28. The cutting head of claim 25, wherein said facing knife relationship is at least partially defined by said facing knife-sweep angle.

29. The cutting head of claim 4, further comprising a plurality of facing knives and corresponding clamping members for clamping said one or more facing knives to the cutting head, each said facing knife including a facing knife-face cutting edge, said clamping members adapted so that each of said plurality of facing knives is clamped to the cutting head independently of the other of said plurality of facing knives.

30. The cutting head of claim 29, wherein each of said facing knives includes at least one pair of linear cutting edges, said pair comprising said facing knife-face cutting edge and a facing knife-chip cutting edge angled with respect to said facing knife-face cutting edge, wherein a facing knife relationship between the cutting head and said facing knife-chip cutting edge is at least partially defined by one of (a) a facing knife-hook angle $\alpha$ in the range $45<\alpha<65$ degrees, and (b) a facing knife-sweep angle $\beta$ in the range $40<\beta<56$ degrees.

31. The cutting head of claim 30, wherein said facing knife relationship is at least partially defined by said facing knife-hook angle.

32. The cutting head of claim 31, wherein said facing knife relationship is at least partially defined by said facing knife-sweep angle.

33. The cutting head of claim 30, wherein said facing knife relationship is at least partially defined by said facing knife-sweep angle.

34. The cutting head of claim 1, further comprising a plurality of facing knives and corresponding clamping members for clamping said one or more facing knives to the cutting head, each said facing knife including a facing knife-face cutting edge, said clamping members adapted so that each of said plurality of facing knives is clamped to the cutting head independently of the other of said plurality of facing knives.

35. The cutting head of claim 34, wherein each of said facing knives includes at least one pair of linear cutting edges, said pair comprising said facing knife-face cutting edge and a facing knife-chip cutting edge angled with respect to said facing knife-face cutting edge, wherein a facing knife relationship between the cutting head and said facing knife-chip cutting edge is at least partially defined by one of (a) a facing knife-hook angle $\alpha$ in the range $45<\alpha<65$ degrees, and (b) a facing knife-sweep angle $\beta$ in the range $40<\beta<56$ degrees.

36. The cutting head of claim 35, wherein said facing knife relationship is at least partially defined by said facing knife-hook angle.

37. The cutting head of claim 36, wherein said facing knife relationship is at least partially defined by said facing knife-sweep angle.

38. The cutting head of claim 35, wherein said facing knife relationship is at least partially defined by said facing knife-sweep angle.

39. The cutting head of claim 1, comprising a plurality of facing knives, distinct from said chipping knives, and corresponding clamping members for clamping said facing knives to the cutting head, each said facing knife including a facing knife-face cutting edge defining a surface of revolution that is parallel to but spaced from said face cutting surface of revolution, said facing knives and corresponding clamping members being adapted so that each of said plurality of facing knives is clamped to the cutting head independently of the other of said plurality of facing knives.

40. The cutting head of claim 39, wherein each of said facing knives includes at least one pair of linear cutting edges, said pair comprising said facing knife-face cutting edge and a facing knife-chip cutting edge angled with respect to said facing knife-face cutting edge, wherein a facing knife relationship between the cutting head and said facing knife-chip cutting edge is at least partially defined by one of (a) a facing knife-hook angle $\alpha$ in the range $45<\alpha<65$ degrees, and (b) a facing knife-sweep angle $\beta$ in the range $40<\alpha<56$ degrees.

41. The cutting head of claim 40, wherein said facing knife relationship is at least partially defined by said facing knife-hook angle.

42. The cutting head of claim 41, wherein said facing knife relationship is at least partially defined by said facing knife-sweep angle.

43. The cutting head of claim 40, wherein said facing knife relationship is at least partially defined by said facing knife-sweep angle.

* * * * *